United States Patent [19]

Luther et al.

[11] Patent Number: 4,724,769

[45] Date of Patent: Feb. 16, 1988

[54] SUBCALIBER, FIN-STABILIZED PENETRATOR PROJECTILE

[75] Inventors: Hans-Werner Luther; Juergen Winkelmann, both of Kaarst, Fed. Rep. of Germany; Patrick Montier, Bourges; Jean-Claude Sauvestre, Doulchard, both of France

[73] Assignee: Rheinmetall GmbH, Düsseldorf, Fed. Rep. of Germany

[21] Appl. No.: 934,761

[22] Filed: Nov. 25, 1986

Related U.S. Application Data

[63] Continuation-in-part of Ser. No. 759,059, Jul. 24, 1985, which is a continuation-in-part of Ser. No. 476,409, Mar. 17, 1983, abandoned.

[30] Foreign Application Priority Data

Mar. 17, 1982 [DE] Fed. Rep. of Germany ..... 3209594

[51] Int. Cl.[4] ..... F42B 11/14

[52] U.S. Cl. ..... 102/518

[58] Field of Search ..... 102/501, 506, 514–519, 102/703

[56] References Cited

U.S. PATENT DOCUMENTS 4,108,072 8/1978 Trinks et al. ..... 102/518

*Primary Examiner*—Harold J. Tudor

[57] ABSTRACT

An improved subcaliber fin-stabilized penetrator projectile having a plurality of high density pre-penetrator elements mounted in axial alignment in front of a main penetrator body. A casing having a frusto-conically shaped inner axial through-bore is threadably mounted on said main penetrator body and said pre-penetrator elements are matingly mounted in said through-bore and have mating frusto-conical shapes. A ballistic hood is threadably mounted on the forward end of the casing. The main penetrator and pre-penetrator elements are made of a high density metal alloy.

6 Claims, 3 Drawing Figures

SUBCALIBER, FIN-STABILIZED PENETRATOR PROJECTILE

CROSS-REFERENCE TO RELATED APPLICATION

This application is a continuation-in-part application of our co-pending application Ser. No. 759,059, filed July 24, 1985 which is a continuation-in-part of application Ser. No. 476,409, filed Mar. 17, 1983, now abandoned.

This application is also related to our co-assigned and allowed application Ser. No. 412,794, filed on Aug. 23, 1982, now U.S. Pat. No. 4,708,064.

BACKGROUND OF THE INVENTION

The projectiles disclosed in the afore-mentioned two applications generally include a plurality of pre-penetrator elements mounted in a casing one behind the other. The pre-penetrator elements of this projectile consist of an alloy of hard metal or metal of high density and the projectile also includes a main penetrator body which is axially disposed behind the pre-penetrator elements and contiguous thereto. This main penetrator body also is generally made of a metal of high density. By providing a plurality of pre-penetrator elements of different sizes or materials, a desired decrease in mass of the projectile arrangement is thereby realized so that, after penetration of a exterior armor, there remains sufficient projectile mass in the form of the main penetrator body for the penetration (i.e. destruction) of the main armor plating disposed behind the exterior armor.

Projectiles of the afore-described type are, at penetration of a plurality of target plates in a direction transversely to the longitudinal axis of the projectile, exposed to certain effective loads, which may lead to a premature bending failure (breaking) of the projectile. If the penetration channel is inclined with respect to the direct linear extension of the projectile flight path, the main penetrator body can, after impacting on the main armor, negatively affect the latter and thereby the effectiveness of the projectile in a very sensitive manner.

In accordance with the allowed and co-assigned U.S. application Ser. No. 412,794 the desired successive reduction of the pre-penetrators cores at penetration of the target is achieved in that the configuration of the abutting pre-penetrator elements and the mating surrounding casing are disigned in such a way that at an inclined impact of the projectile on the target certain transverse forces act on the pre-penetrator elements with adaptation for different targets so as to lead to a controlled pre-penetrator reduction. such a tolerating of the dimensioning has proven to be quite cumbersome. In view of the fact that the casing surrounding the pre-penetrator elements must in the known arrangement have the same wall thickness from front to back, the danger exist that it, as a result of the laterally acting forces, breaks prematurely at rearwardly located loci and thereby the desired effect of the successive breaking off of the individual pre-penetrator elements is not achieved.

SUMMARY OF THE INVENTION

It is a general object of the invention to provide a projectile in which the desired breaking off of the pre-penetrator elements is achieved successively from front to back with safety despite increasing lateral forces. In addition to this principal object, the projectile of the invention avoids the cumbersome fitting operations and provides pre-penetrator elements that are simple to manufacture because the elements are in the form of frusto-conically shaped elements.

These objects of the invention are achieved in that the first pre-penetrator element effects already a penetration channel on the target that is of larger diameter than the diameter of the next following pre-penetrator element, so that the fragments of the corresponding pre-penetrator element do not hinder the next following pre-penetrator element during its penetration at the target. By decreasing the cross-section of the pre-penetrator elements from front to back, the cross-section of the surrounding casing must conversely be increased so that the fragment of the corresponding pre-penetrator element does not hinder the successive pre-penetrator element during its penetration work at the target. By progressively increasing the cross-section of the casing surrounding the pre-penetrator elements from front to back there is achieved that the material which forms the casing, which is made of relatively ductile material, breaks only successively at the respective region of the separating surface of the abutting pre-penetrator elements from front to back. The penetrator body, pre-penetrator elements and casing all are made of "metal of high density."

The expression "metal of high density" means an alloy having a hard metal content or an alloy having a content of metal of high density or a metal of high density alloy, the high density metal content being more ductile than the hard metal content and the hard metal content being less ductile, that is it is more brittle than the high density metal content. When the metal alloy is to be tough, i.e. duticle, the metal alloy should contain between 90% to 98% of tungsten and the binding material amounts up to 3.5% nickel and up to 1.5% Fe, and in certain cases up to 1% Cobalt. With a brittle metal alloy the alloy should contain about 99% tungsten and as a binding material traces of iron or nickel. In both cases the high required density is about 18 grams/cm$^3$. In lieu of tungsten uranium can also be used.

BRIEF DESCRIPTION OF THE DRAWING

The above and other feature and advantages will become more readily apparent from the following, reference being made to the accompanying drawing in which.

DETAILED DESCRIPTION

Figure 2:
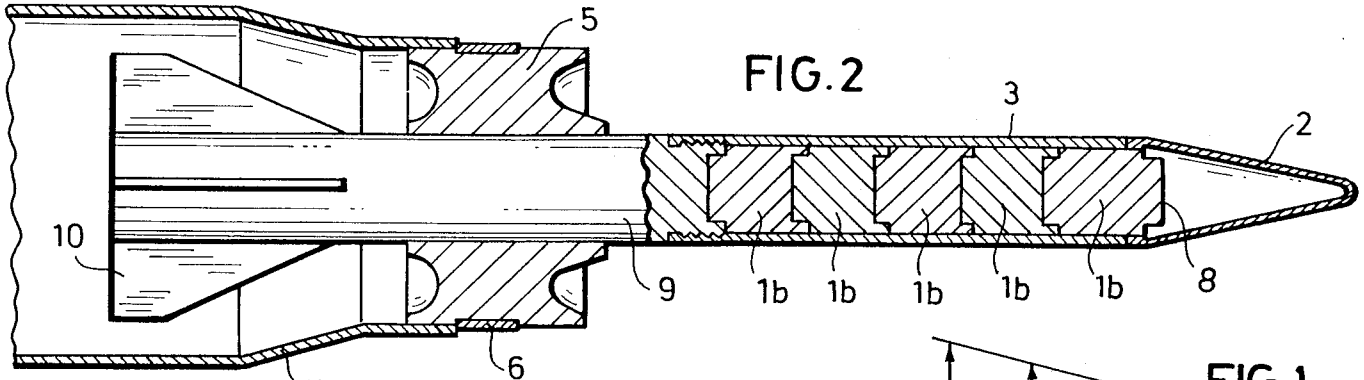
FIG. 2 illustrates a projectile in accordance with our co-assigned allowed U.S. patent application Ser. No. 412,794.

The new projectile includes a casing 36', the wall thickness of which steadily increases from a front edge 36'' rearwardly to a region 37'' while the exterior diameter of the casing remains essentially constant. The casing 36' has, in the vicinity of the forward edge 36'', an exterior thread 37 which serves for a detachable connection between a ballistic hood 44 and the casing 36'. The ballistic hood 44 is provided in a region 45 with an internal cylindrical bore surface 45' which extends forwardly up to an edge 43.

From this edge 43 forwardly the ballistic hood has a uniform wall thickness and extends up to a nose point region 46. The nose penetrator 10 has a forwardly projecting cylindrical portion 10' which has an outer cylindrical surface 13' that is in intimate contact with the inner cylindrical surface 45' of the ballistic hood 46 so as to jointly form a tight fit. An end face 12' of the projecting portion 10' has a circular cutting edge 13 where the end surface 12' meets with the cylindrical peripheral surface 13'. The projecting portion 10' is adjoined rearwardly by a frusto-conically shaped portion 10'' with which it is integral.

The next rearwardly following pre-penetrator elements 20, 70 to 80 also have frusto-conical shapes. The abutting surfaces of these contiguous pre-penetrator elements are of equal size and have not been designated in the drawing with special reference numbers.

Figure 3:
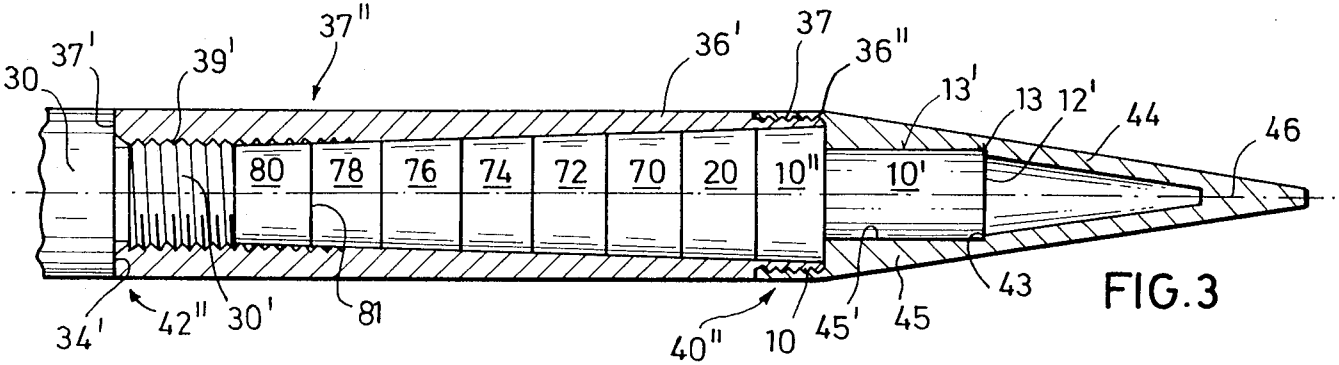
FIG. 3 illustrates one embodiment of the projectile in accordance with this invention.

The peripheral surfaces of the front-most pre-penetrator element portion 10'' and the pre-penetrator elements 20 and 70 to 78 are matingly contacted by the inner surfaces of the casing 36' so as to form a tightly fitted assembly. While the forward region 81 of the pre-penetrator element 80 is still tightly enclosed by the inner surface of the casing 36', a rearward continuation of this casing to the rear annular end face 37' is of a cylindrical shape and has an internal thread thereby surrounding the rearward edges of the pre-penetrator element 80 as well as the forwardly projecting cylindrical portion 30' of a main penetrator body 30, the exterior diameter of which corresponds to the external diameter of the casing 36'. A forwardly facing annular surface 34' of the main penetrator body 30 is in intimate contact with the rearwardly facing surface 37' of the casing 36'. The forwardly projecting portion 30' of the main penetrator body 30, with which it is integral has an external thread and the casing 36' has a mating internal thread in its rear portion as illustrated in FIG. 3. By providing a threadably detachable connection between the ballistic hood 46 and the casing 36' it is quite easy to exchange in the field the pre-penetrator elements 20, 70 to 80 for other pre-penetrator elements of different material or length and thereby facilitate the adjustment of the mass of the projectile to different targets.

By forming the abutting surfaces of adjoining pre-penetrator elements as a pivot joint (i.e. spherical-concave) it is possible at a skewed impact on a target to achieve a re-orientation of each part following a pre-penetrator in the flight direction so that an indistorted penetration results and a premature breaking up of the following penetrator element is avoided.

The afore-described arrangement can, in case of need, make possible an exchange in the field of the pre-penetrator elements 10, 20, 70 to 80, in order to adapt the projectile to conditions arising in the field and in particular with respect to a sighted target. In order to effectuate such an exchange, no additional auxiliary means are necessary. Since the largest diameter of the pre-penetrator element 10 provides for a corresponding penetration cross-section in a pre-armor, the following pre-penetrator element 20, 70 to 80 can without any significant hindrance be effective against numerous armor platings that are arranged behind the pre-armor. This favors the effectiveness of the main penetrator body 30 against the main armor. The threads 37 and 39' are arranged on corresponding intermediate regions 40'' and 42''.

The mass relationship of the pre-penetrator cores can be 1:1.2:6, whereby the first numerical value represents the first pre-penetrator 10, the second numerical value the second pre-penetrator element 20 and the third numerical value the main penetrator 30. The main penetrator 30 is preferably made out of a high-strength ductile heavy metal alloy, for example a sintered alloy having a tungsten content of, for example 90 to 98% tungsten with up to 3.5% nickel, up to 1.5% Fe and under certain circumstances 1% of Co, whereas the pre-penetrator elements are made of a material with reduced ductility, for example 99% tungsten and traces of Ni+Fe.

Figure 1:
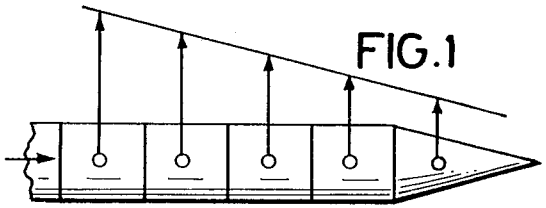
FIG. 1 illustrates schematically the increase of the lateral forces at penetration of the target which act on a penetrator projectile.

When the projectile of the invention impacts on a target at a scewed angle sufficient forces act transversely to the longitudinal axis of the projectile (see FIG. 1) to break the casing successively in the region of the respective separating planes of the contiguous pre-penetrator elements. The casing 36, made out of a ductile material of sufficient strength, can in such a case absorb a portion of the transverse forces by deformation and serves for a maximum force transfer between the adjoining surfaces of the pre-penetrator cores. Thereby it is assured that an axial impact-force component of sufficient size effectively acts against the target. The fracture zones in the region of the corresponding separating surfaces of abutting pre-penetrator elements only becomes effective when the corresponding separating region reaches a penetration channel of the target which has been formed by the effect of the pre-penetrator element 10 on the target and, in the preponderance of cases, is inclined with respect to the flight path of the projectile. In this manner fragments from the pre-penetrator element 10 can no longer hinder the next-following pre-penetrator element 20 during its further penetration work on the target.

Although the embodiment of the invention has been illustrated in the accompanying drawings and described in the foregoing specification, it is to be especially understood that various changes, such as in the relative dimensions of the parts, materials used, and the like, as well as the suggested manner of use of the apparatus of the invention, may be made therein without departing from the spirit and scope of the invention, as will now be apparent to those skilled in the art.

I claim:

1. An improved subcaliber fin-stabilized projectile for combatting multi-armor plated targets having a projectile body of uniform cylindrical shape over substantially its entire axial length, the improvement comprising in combination, a main penetrator body, a preselected plurality of frusto-conically shaped pre-penetrator armor piercing elements coaxially operatively mounted in front of said main penetrator body, said plurality of pre-penetrator elements jointly forming in their assembled state a frusto-coaxially shaped body, a casing having a smooth cylindrical outer shape and a frusto-conically shaped bore so that the wall thickness of said coaxially mounted casing progressively increases from front to back, said frusto-conically shaped armor piercing elements being matingly mounted in said bore; the diameter of said main penetrator body substantially corresponding to the outer diameter of said casing;

first and second thread means are respectively disposed on the front and rear end of said casing;

a ballistic hood coaxially threadably mounted via said first thread means on the front end of said casing, said main penetrator body being coaxially threadably connected via said second thread means to the rear end of said casing;

and cutting surface means on at least the forward-most of said pre-penetrator elements for penetrating said target.

2. The improved subcaliber penetrator projectile as set forth in claim 1, wherein said forward-most pre-penetrator element has a forwardly projecting cylindrical portion which extends into said ballistic hood and which has a front circular cutting edge.

3. The improved subcaliber penetrator projectile as set forth in claim 2, wherein the rear portion of said casing has a threaded internal cylindrical bore and said main penetrator body has a forwardly extending cylindrical threaded front portion which is threadably mounted via said second thread means in said casing.

4. The improved subcaliber penetrator projectile as set forth in claim 3, wherein the mass ratio between the main penetrator body and the pre-penetrator elements ranging from 6 to 1.

5. The improved subcaliber penetrator projectile as set forth in claim 4, wherein the main penetrator body is made of a ductile metal alloy.

6. The improved subcaliber penetrator projectile as set forth in claim 5, wherein said metal alloy consists of 90% to 98% tungsten and up to 3.5% Ni and up to 1.5% Fe and up to 1% Co.

* * * * *

UNITED STATES PATENT AND TRADEMARK OFFICE

CERTIFICATE OF CORRECTION

PATENT NO. : 4,724,769

DATED : February 16, 1988

INVENTOR(S) : Hans-Werner LUTHER ET AL

It is certified that error appears in the above-identified patent and that said Letters Patent are hereby corrected as shown below:

Page 1, Assignee: Rheinmetall GmbH., Düsseldorf, Fed. Rep. of Germany, add the following:

--and ETAT FRANCAIS represente par le DELEGUE GENERAL pour l'ARMAMENT BUREAU DES BREVETS ET INVENTIONS, Paris Armeés, France--

Signed and Sealed this

Eleventh Day of October, 1988

*Attest:*

*Attesting Officer*

DONALD J. QUIGG

*Commissioner of Patents and Trademarks*